US009724709B2

(12) United States Patent
Prociw et al.

(10) Patent No.: US 9,724,709 B2
(45) Date of Patent: Aug. 8, 2017

(54) SWIRLER ELEMENTS FOR NOZZLES

(71) Applicants: Delavan Inc, West Des Moines, IA (US); Delavan Limited, West Midlands (GB)

(72) Inventors: Lev A. Prociw, Johnston, IA (US); Neil Smith, Lancashire (GB); Frank Whittaker, Cheshire (GB)

(73) Assignees: Delavan Inc, West Des Moines, IA (US); Delavan Limited, West Midlands (GB)

( * ) Notice: Subject to any disclaimer, the term of this patent is extended or adjusted under 35 U.S.C. 154(b) by 128 days.

(21) Appl. No.: 14/161,974

(22) Filed: Jan. 23, 2014

(65) Prior Publication Data

US 2015/0048183 A1 Feb. 19, 2015

Related U.S. Application Data

(60) Provisional application No. 61/866,163, filed on Aug. 15, 2013.

(51) Int. Cl.
*B05B 1/34* (2006.01)

(52) U.S. Cl.
CPC ..... *B05B 1/3436* (2013.01); *B05B 1/3426* (2013.01)

(58) Field of Classification Search
CPC ..... B05B 1/3436; B05B 1/3426
USPC ..... 239/468, 461, 463, 470, 487, 492
See application file for complete search history.

(56) References Cited

U.S. PATENT DOCUMENTS

| | | | | |
|---|---|---|---|---|
| 3,532,271 | A * | 10/1970 | Polnauer | 239/1 |
| 3,771,728 | A * | 11/1973 | Polnauer | F23D 11/383 239/468 |
| 7,611,079 | B2 | 11/2009 | Whittaker et al. | |
| 2008/0217435 | A1* | 9/2008 | Whittaker | B05B 1/00 239/468 |
| 2009/0194611 | A1* | 8/2009 | Whittaker et al. | 239/490 |

* cited by examiner

*Primary Examiner* — Arthur O Hall
*Assistant Examiner* — Tuongminh Pham
(74) *Attorney, Agent, or Firm* — Locke Lord LLP; Scott D. Wofsy; Christopher J. Cillié

(57) ABSTRACT

A swirl element for swirling fluid in a nozzle has a swirler body. The swirler body defines a feed channel including an axially oriented channel surface and a swirl chamber in fluid communication with the feed channel. The swirl chamber defines a radially oriented swirler surface substantially normal to the channel surface. The swirl chamber and the axially oriented channel are in fluid communication through a tangential slot for imparting swirl on fluids passing from the feed channel into the swirl chamber. The tangential slot includes a smoothly rounded surface transitioning from the channel surface to the swirler surface for providing a smooth, substantially separation free transition in fluid flow from the channel into the swirl chamber.

11 Claims, 2 Drawing Sheets

SWIRLER ELEMENTS FOR NOZZLES

CROSS-REFERENCE TO RELATED APPLICATIONS

This application claims the benefit of priority to U.S. Provisional Patent Application No. 61/866,163 filed Aug. 15, 2013 and is incorporated by reference herein in its entirety.

BACKGROUND OF THE INVENTION

1. Field of the Invention

The present disclosure relates to nozzles, and more particularly to swirler elements for nozzles for swirling fluid flowing through the nozzle, for example as in spray dry nozzles.

2. Description of Related Art

Fluid nozzles or atomizers having a spiral swirl chamber have been employed for various applications including spray drying, aeration, cooling, and fuel injection. Such nozzles operate by forcing a liquid including a suspension, dispersion, emulsion, or slip of abrasive material through a swirl chamber. The swirl chamber changes the direction of the liquid and imparts a rotation or swirl to the fluid flow. This causes the fluid to exit the nozzle in a cone of small droplets that are well dispersed into the environment outside the nozzle.

In applications such as spray drying, the fluid feed pressure supplies the energy for fluid atomizing. The fluid feed pressure can exceed 5,000 psi, and in certain applications, exceeds 10,000 psi. Such pumping pressures require considerable input energy. They also impose an upper limit to pressure and flow rate that is a function of the internal geometry of the swirler unit. The swirler unit itself also has a limited service life owing the tendency of material transiting the swirler unit to change, e.g. erode, the geometry of the swirler unit.

Conventional swirler units have generally been considered satisfactory for their intended purpose. However, there is a need for swirler units that allow for achieving a predetermined flow velocity with reduced pumping pressure. There is also a continuing need for swirler units that durable and easy to make and use. The present disclosure provides a solution to these needs.

SUMMARY OF THE INVENTION

The subject disclosure is directed to a new and useful swirl element for swirling fluid in a nozzle. The swirl element includes a swirler body. The swirler body defines a feed channel including an axially oriented channel surface and a swirl chamber in fluid communication with the feed channel. The swirl chamber defines a radially oriented swirler surface substantially normal to the channel surface. The swirl chamber and axial channel are in fluid communication through a tangential slot for imparting swirl on fluids passing from the feed channel into the swirl chamber. The tangential slot includes a smoothly rounded surface transitioning from the channel surface to the swirler surface for providing a smooth, substantially separation free transition in fluid flow from the channel into the swirl chamber.

In certain embodiments, the tangential slot can define a metering orifice coupling the axial channel and swirl chamber for metering flow passing into the swirl chamber. The channel surface can define an arcuate cross-section. It is contemplated that the smoothly rounded surface transitioning from the channel surface to the swirler surface can be tangent with the swirler surface. The smoothly rounded surface can also be tangent with at least one portion of the channel surface.

A spray nozzle includes a nozzle body. The nozzle body defines an interior bore extending from an inlet to an opposed outlet with an interior locating surface defined in the interior bore. A swirl element as described above is disposed within the interior bore engaged with the locating surface with the swirl chamber positioned proximate the outlet of the nozzle body. An orifice disc is disposed within the central bore between the swirl element and the outlet of the nozzle body. The orifice disc defines an orifice therethrough in fluid communication with the swirl chamber and the outlet of the nozzle body for issuing a swirling spray from the nozzle body outlet.

In certain embodiments, the spray nozzle can include a locking member engaged within the central bore for locking the swirl element and orifice disc within the central bore. The locking member can define a flow passage from the inlet of the nozzle body to the channel of the swirl element. The channel surface can define an arcuate cross-section, the central bore can be circular, and the channel surface and the central bore can define flow passage with a biconvex lens shaped cross-section.

These and other features of the systems and methods of the subject disclosure will become more readily apparent to those skilled in the art from the following detailed description of the preferred embodiments taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, preferred embodiments thereof will be described in detail herein below with reference to certain figures, wherein.

DETAILED DESCRIPTION OF THE PREFERRED EMBODIMENTS

Figure 1:
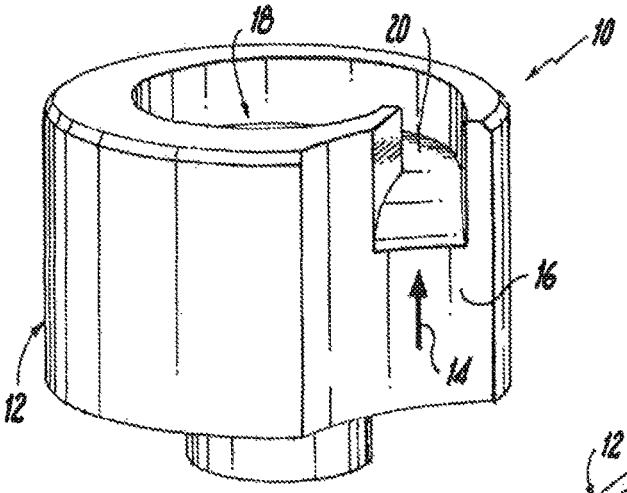
FIG. 1 is a perspective view of a swirl element, showing the feed channel including the axially oriented channel surface.

Reference will now be made to the drawings wherein like reference numerals identify similar structural features or aspects of the subject disclosure. For purposes of explanation and illustration, and not limitation, a view of an exemplary embodiment of a swirl element in accordance with the disclosure is shown in FIG. 1 and is designated generally by reference character 10. Other embodiments of the swirl element in accordance with the disclosure, or aspects thereof, are provided in FIGS. 2-5, as will be described. Swirl element 10 can be used for swirling fluid, such as for atomizing a fluid for example.

Figure 2:
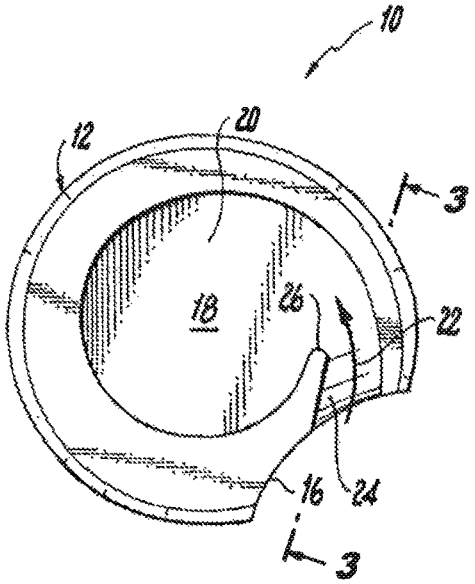
FIG. 2 is plan view of the swirl element of FIG. 1, showing the swirler surface and metering orifice.

Swirler element 10 includes a swirler body 12 and a feed channel 14. Swirler body 12 defines feed channel 14, an axially oriented channel surface 16, and a swirl chamber 18 in fluid communication with feed channel 14. Swirl chamber 18 defines a radially oriented swirler surface 20 substantially normal to channel surface 16. Swirl chamber 18 and axial channel 14 are in fluid communication through a tangential slot 22 as shown in FIG. 2, for imparting swirl on fluids passing from feed channel 14 and into swirl chamber 18. Swirler body 12 is constructed from tungsten carbide, hardened stainless steel, a ceramic material, or any other suitable material for a given application.

With reference to FIG. 2, tangential slot 22 includes a smoothly rounded surface 24 transitioning from channel surface 16 to swirler surface 20 for providing a smooth, substantially separation free transition in fluid flow from channel 14 into the swirl chamber 18. Channel surface 16 also defines an arcuate cross-section 28. Tangential slot 22 defines a metering orifice 26 that couples axial channel 14 and swirl chamber 18 for metering fluid flow passing into swirl chamber 18. The geometry and area of metering orifice 26 define the flow rate of fluid transiting swirl element 10 for a given pumping pressure.

Figure 3:
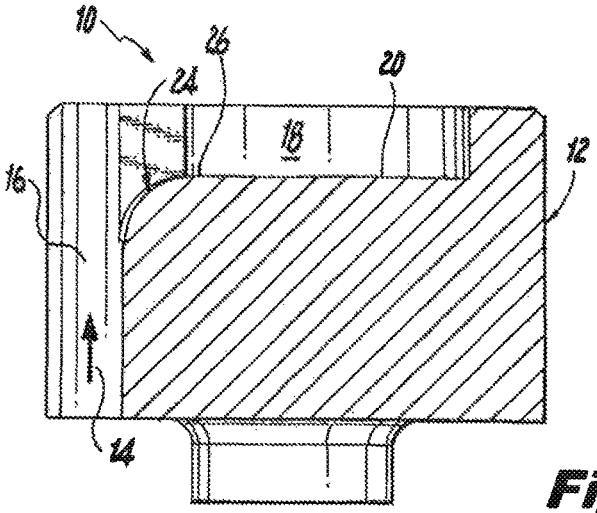
FIG. 3 is a cross-sectional side elevation view of the swirl element of FIG. 1, showing the smoothly rounded surface transitioning from the channel surface to the swirler surface.

With reference to FIG. 3, swirler element 10 is shown in cross-section. Smoothly rounded surface 24 transitions from channel surface 16 to swirler surface 20 so as to be tangent with the swirler surface 20. Smoothly rounded surface 24 intersects metering orifice 26 in a plane defined by metering orifice 26 obliquely intersecting smoothly rounded surface 24. Smoothly rounded surface 24 transitions from channel surface 16 to the swirler surface 20 is tangent with at least one portion of channel surface 16. Smoothly rounded surface 24 can be a chamfered surface, for example.

Figure 4:
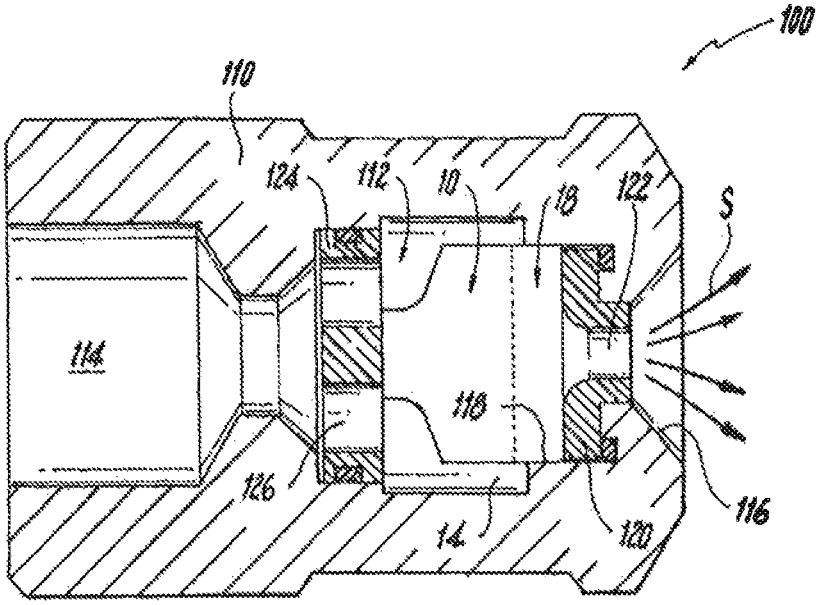
FIG. 4 is schematic cross-sectional side elevation view of a spray nozzle, showing the swirl element of FIG. 1 disposed within an interior bore of the nozzle.

With reference to FIG. 4, a spray nozzle 100 is shown. Spray nozzle 100 is similar in construction to that described in U.S. Pat. No. 7,611,079, the contents of which are incorporated herein by reference in the their entirety. Spray nozzle 100 includes a nozzle body 110. Nozzle body 110 defines an interior bore 112 extending from an inlet 114 to an opposed outlet 116 with an interior locating surface 118 defined in interior bore 112. Swirl element 10 as described above is disposed within interior bore 112 and is engaged with locating surface 118 such that swirl chamber 18 is positioned proximate outlet 116 of nozzle body 110. An orifice disc 120 is disposed within interior 112 between swirl element 10 and outlet 116 of nozzle body 110. One side of bore 112 should be tight with one side of swirl element 10 to bound channel 14 as shown in FIG. 3. Orifice disc 120 defines an orifice 122 therethrough in fluid communication with swirl chamber 18 and outlet 116 of nozzle body 110 for issuing a swirling spray S from nozzle body outlet 116.

Spray nozzle 100 includes a locking member 124 engaged within central bore 114 for locking swirl element 10 and orifice disc 120 within interior 112. Locking member 124 defines a flow passage 126 from inlet 114 of nozzle body 110 to the channel 14 of swirl element 10. Channel surface 16 (shown in FIG. 2) defines an arcuate cross-section, and central bore 114 defines a circular shape. Channel surface 16 and an opposed inner surface portion of central bore 114, indicated with dashed lines in FIG. 2, define flow passage with a biconvex lens shaped cross-section.

Figure 5A:
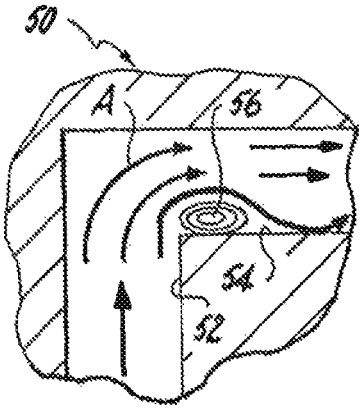
FIG. 5A is a schematic cross-sectional view of a conventional swirl element, showing a flow map of fluid transiting a conventional swirl element.

With reference to FIG. 5A, fluid flow A is shown transiting a conventional swirl element 50. Conventional swirl element 50 has a flow path defined by a sharp corner at the intersection of surfaces 52 and 54. The sharp corner creates an eddy 56 within the swirl chamber, resulting in a vena contracta causing a pressure loss and requiring a relatively high pumping pressure for a given flow rate.

Figure 5B:
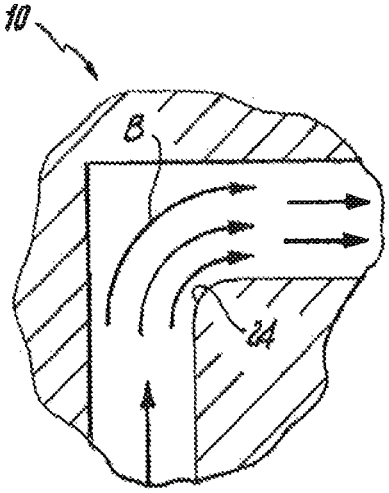
FIG. 5B is schematic cross-sectional view of the swirl element of FIG. 1, showing a flow map of fluid transiting the swirl element.

With reference to FIG. 5B, fluid flow B is shown transiting swirl element 10. As described above, smoothly rounded surface 24 allows for gradual acceleration of flow into the swirl chamber. No eddy and corresponding vena contracta is present within fluid flow B nor is there any associated pressure loss. Pumping pressure is relatively low for the predetermined flow rate.

The methods and systems of the present disclosure, as described above and shown in the drawings, provide methods and systems for swirling a fluid flow in a swirl unit at a predetermined velocity with reduced pumping pressure. While the apparatus and methods of the subject disclosure have been shown and described with reference to preferred embodiments, those skilled in the art will readily appreciate that changes and/or modifications may be made thereto without departing from the spirit and scope of the subject disclosure.

What is claimed is:

1. A swirl element for swirling fluid in a nozzle comprising:

a swirler body defining:

a feed channel including an axially oriented channel surface;

a swirl chamber in fluid communication with the feed channel; and a narrow neck portion defined by an end of the swirler body opposite the swirl chamber, wherein the swirl chamber defines a radially oriented swirler surface substantially normal to the channel surface, wherein the swirl chamber and the feed channel are in fluid communication through a tangential slot for imparting swirl on fluids passing from the feed channel into the swirl chamber, wherein the tangential slot includes a smoothly rounded surface transitioning from the channel surface to the swirler surface for providing a smooth, substantially separation free transition in fluid flow from the feed channel into the swirl chamber, wherein the tangential slot has a metering orifice defining the smallest flow area between the feed channel and the swirl chamber for metering flow into the swirl chamber, wherein the smoothly rounded surface is upstream of the metering orifice and the swirl chamber is downstream of the metering orifice, wherein the smoothly rounded surface is tangent to the swirler surface at the metering orifice.

2. A swirl element as recited in claim 1, wherein the feed channel has an axial flow area, the axial flow area being bounded by an arcuate segment defined by the channel surface, the arcuate segment intersecting a circumference of the swirler body at opposite ends, and the smoothly rounded surface of the tangential slot joining the feed channel along a portion of the arcuate segment disposed between the opposite ends of the arcuate segment.

3. A swirl element as recited in claim 1, wherein the smoothly rounded surface transitioning from the channel surface to the swirler surface is tangent with at least one portion of the channel surface.

4. A spray nozzle, comprising:

a nozzle body defining an interior bore extending from an inlet to an opposed outlet with an interior locating surface defined in the interior bore;

a swirl element as recited in claim 1 disposed within the interior bore and engaged with the locating surface such that the swirl chamber positioned proximate the outlet of the nozzle body; and an orifice disc disposed within the central bore between the swirl element and the outlet of the nozzle body, wherein the orifice disc defines an orifice therethrough in fluid communication with the swirl chamber and the outlet of the nozzle body for issuing a swirling spray from the nozzle body outlet.

5. A spray nozzle, as recited in claim 4, further comprising a locking member engaged within the central bore for locking the swirl element and the orifice disc within the central bore, the locking member defining a flow passage from the inlet of the nozzle body to the feed channel of the swirl element.

6. A spray nozzle as recited in claim 4, wherein the channel surface defines an arcuate cross-section, wherein the central bore is circular, and wherein the channel surface and the central bore define flow passage with a biconvex lens shaped cross-section for swirling a fluid flow in a swirl unit at a predetermined velocity with reduced pumping pressure.

7. A spray nozzle as recited in claim 4, wherein the smoothly rounded surface transitioning from the channel surface to the swirler surface is tangent with at least one portion of the channel surface.

8. A spray nozzle, comprising:

a nozzle body defining an interior bore extending from an inlet to an opposed outlet with an interior locating surface defined in the interior bore;

a swirl element as recited in claim 1 disposed within the interior bore engaged with the locating surface with the swirl chamber positioned proximate the outlet of the nozzle body;

an orifice disc disposed within the central bore between the swirl element and the outlet of the nozzle body, wherein the orifice disc defines an orifice therethrough in fluid communication with the swirl chamber and the outlet of the nozzle body for issuing a swirling spray from the nozzle body outlet, wherein the channel surface defines an arcuate cross-section, wherein the central bore is circular, and wherein the channel surface and the central bore define flow passage with a biconvex lens shaped cross-section for swirling a fluid flow in a swirl unit at a predetermined velocity with reduced pumping pressure, wherein the smoothly rounded surface transitioning from the channel surface to the swirler surface is tangent with the swirler surface, and wherein the smoothly rounded surface transitioning from the channel surface to the swirler surface is tangent with at least one portion of the channel surface; and a locking member engaged within the central bore for locking the swirl element and orifice disc within the central bore, wherein the locking member defines a flow passage from the inlet of the nozzle body to the feed channel of the swirl element.

9. A spray nozzle as recited in claim 8, wherein the swirler body includes a narrow neck portion centrally defined along an axis defined by the swirler body and disposed on an end of the swirler body opposite the swirl chamber, wherein the neck portion axially abuts the locking member.

10. A swirl element as recited in claim 1, wherein the metering orifice is tangent to the smoothly rounded surface.

11. A swirl element as recited in claim 1, wherein the channel surface is tangent to the smoothly rounded surface.

* * * * *